US008298737B2

(12) United States Patent
Kadokura et al.

(10) Patent No.: US 8,298,737 B2
(45) **Date of Patent: *Oct. 30, 2012**

(54) WHITE TONER FOR ELECTROSTATIC CHARGE IMAGE DEVELOPMENT, ELECTROSTATIC CHARGE IMAGE DEVELOPER, TONER CARTRIDGE, PROCESS CARTRIDGE, AND IMAGE FORMING APPARATUS

(75) Inventors: Yasuo Kadokura, Kanagawa (JP); Yukiaki Nakamura, Kanagawa (JP); Noriyuki Mizutani, Kanagawa (JP); Atsushi Sugawara, Kanagawa (JP); Yusuke Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 262 days.

This patent is subject to a terminal disclaimer.

(21) Appl. No.: 12/873,669

(22) Filed: Sep. 1, 2010

(65) Prior Publication Data

US 2011/0183247 A1 Jul. 28, 2011

(30) Foreign Application Priority Data

Jan. 27, 2010 (JP) ..... 2010-015469

(51) Int. Cl.
*G03G 9/09* (2006.01)

(52) U.S. Cl. ..... 430/108.1; 430/107.1

(58) Field of Classification Search ..... 430/104–108.1
See application file for complete search history.

(56) References Cited

U.S. PATENT DOCUMENTS 5,759,731 A 6/1998 Hagi et al.
2008/0069598 A1* 3/2008 Murakami et al. ..... 399/265
2009/0305160 A1* 12/2009 Gal et al. ..... 430/112
2011/0159422 A1 6/2011 Nakamura et al.

FOREIGN PATENT DOCUMENTS

| | | |
|---|---|---|
| JP | A-5-107798 | 4/1993 |
| JP | A-8-339095 | 12/1996 |
| JP | A-10-10771 | 1/1998 |
| JP | A-2001-49146 | 2/2001 |
| JP | A-2002-108021 | 4/2002 |
| JP | A-2009-134060 | 6/2009 |

OTHER PUBLICATIONS

Reade Advanced Materials (http://www.reade.com/Particle_Brief-ings/spec_gra.html), 2006 Reade Advanced Materials.*
Sekisui Plastics Co., Ltd. (http://www.tech-p.com/en/products/in-dex.html), 2007 Sekisui Plastics Co., Ltd.*
Sekisui Plastics Co., Ltd. (http://tech-p.com/en/products/index.html), 2007 Sekisui Plastics Co., Ltd.
Jun. 25, 2012 Notice of Allowance issued in U.S. Appl. No. 12/780,529.

* cited by examiner

*Primary Examiner* — Christopher Rodee
*Assistant Examiner* — Rashid Alam
(74) *Attorney, Agent, or Firm* — Oliff & Berridge, PLC

(57) ABSTRACT

A white toner for electrostatic charge image development is disclosed. The white toner for electrostatic charge image development includes a binder resin, a first white pigment, a second white pigment, and a release agent, a specific gravity D1 of the first white pigment satisfying a condition of 3.5<D1<6.0, a specific gravity D2 of the second white pigment satisfying a condition of 0.3<D2<1.2, a total content of the first white pigment and the second white pigment being in the range of from about 20% by weight to about 50% by weight with respect to a total weight of the white toner for electrostatic charge image development, and the release agent including a metal salt.

14 Claims, 1 Drawing Sheet

WHITE TONER FOR ELECTROSTATIC CHARGE IMAGE DEVELOPMENT, ELECTROSTATIC CHARGE IMAGE DEVELOPER, TONER CARTRIDGE, PROCESS CARTRIDGE, AND IMAGE FORMING APPARATUS

CROSS-REFERENCE TO RELATED APPLICATION

This application claims priority under 35 USC 119 from Japanese Patent Application No. 2010-015469, filed on Jan. 27, 2010.

BACKGROUND

The present invention relates to a white toner for electrostatic charge image development, an electrostatic charge image developer, a toner cartridge, a process cartridge, and an image forming apparatus.

SUMMARY

According to an aspect of the present invention, there is provided a white toner for electrostatic charge image development including a binder resin, a first white pigment, a second white pigment, and a release agent, a specific gravity D1 of the first white pigment satisfying a condition of 3.5<D1<6.0, a specific gravity D2 of the second white pigment satisfying a condition of 0.3<D2<1.2, a total content of the first white pigment and the second white pigment being in the range of from about 20% by weight to about 50% by weight with respective to a total weight of the white toner for electrostatic charge image development, and the release agent including a metal salt.

BRIEF DESCRIPTION OF THE DRAWINGS

Exemplary embodiment of the present invention is described in detail based on the following FIGURE, wherein.

DETAILED DESCRIPTION

Figure 1:
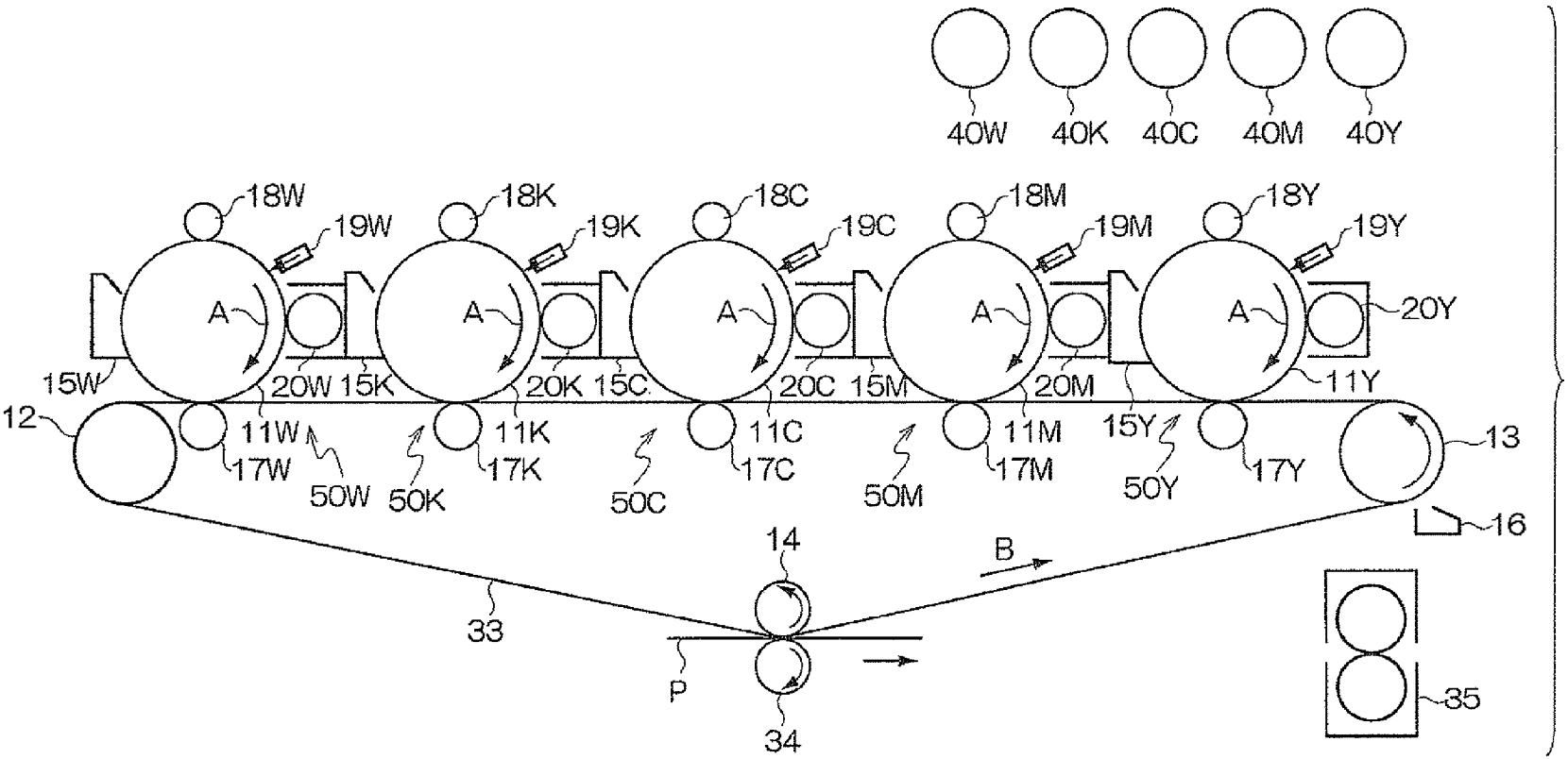
FIG. 1 is a schematic configuration diagram illustrating an example of an image forming apparatus according to an exemplary embodiment of the present invention

Hereinbelow, a white toner for electrostatic charge image development, an electrostatic charge image developer, a toner cartridge, a process cartridge, and an image forming apparatus of exemplary embodiments of the present invention are described.

White Toner for Electrostatic Charge Image Development

The white toner for electrostatic charge image development (hereinafter, may also be simply referred to as "white toner") according to an exemplary embodiment of the invention includes a binder resin, a first white pigment, a second white pigment, and a release agent, in which a specific gravity D1 of the first white pigment satisfies a condition of 3.5<D1<6.0, a specific gravity D2 of the second white pigment satisfies a condition of 0.3<D2<1.2, a total content of the first white pigment and the second white pigment is in the range of from 20% by weight (or about 20% by weight) to 50% by weight (or about 50% by weight) with respect to a total weight of the white toner for electrostatic charge image development, and the release agent includes a metal salt.

In the white toner, in general, an inorganic material, for example, a pigment with a large specific gravity such as titanium oxide, zinc oxide, or zinc sulfide, is used as the white pigment. In order to address coloring power and concealment power, the content of the white pigment in the white toner increases, whereby soaking of the release agent out of the surface of the toner image may be suppressed at the time of fixing a toner image. Particularly, when two or more types of white pigments are used, the dispersibility of the white pigment is improved, and the soaking of the release agent out of the surface of the toner image may be further suppressed for some unknown reasons. The white toner according to this exemplary embodiment contains the pigments by the total content in the range of from 20% by weight to 50% by weight, which is greater than that of a typical color toner. A large content of the white pigments may cause the difficulty in the soaking of the release agent out of the surface of the toner image.

In this exemplary embodiment, the release agent contains a metal salt. Accordingly, when the toner is produced by a wet production method such as an emulsion aggregation method, the release agent may easily exist in the vicinity of the surface of the toner. Since the release agent may exist near the surface of the toner, the release agent may easily soak out of the surface of the toner image at the time of fixing the toner image, and thus, the surface of the toner image may be protected by the release agent. As a result, the storage stability of the toner image may be improved.

A white toner may be used, for example, in a method in which priming a colored transfer medium such as colored paper or black paper or a transfer medium of a transparent material with a white toner image, that is, forming a concealment layer with the white toner, and forming a color image thereon to draw an image, thereby reducing the influence of a ground color and improving the coloring property. A white toner may also be used for drawing an image on a colored transfer medium such as colored paper or black paper or a transfer medium of a transparent material.

The coloring power or the concealment power of white in the white toner image is based on a principle that light is scattered using the refractive index difference between the white pigment and the binder resin, but the transmission of light is not intercepted in essence. Accordingly, for example, in order to ensure concealment property sufficient for actual use and to obtain a color image with an excellent coloring property, a large amount of white pigment may be added with respect to the binder resin or the white toner image may be formed with a large thickness.

Therefore, the toner image (the fixed image) formed with the white toner may tend to have decreased bending strength.

The reason is thought as follows. Since inorganic materials (such as titanium dioxide, zinc oxide, or zinc sulfide) are generally used as the white pigments, and thus, the specific gravity of the white pigment tend to be greater than that of the binder resin in the white toner image (the fixed image thereof), the dispersibility of the white pigments in the image may decrease and the white pigment may locally aggregate, whereby the bending strength may decrease.

However, with the white toner according to this exemplary embodiment, it is possible to obtain a white toner image with great bending strength by together using at least two types of white pigments satisfying the above conditions of specific gravity.

Although the reason is not clear, it is thought that by using the second white pigment with a small specific gravity together with the first white pigment which may have a high specific gravity and have relatively high coloring power and concealment power, the phenomenon that the first white pigment with a high specific gravity aggregates locally at the time of fixing the white toner image may be suppressed due to the second white pigment with a low specific gravity, and the dispersibility of the first white pigment may be improved. As a result, the white toner image may be fixed in the state where the total white pigments are dispersed evenly.

For the supposed reason as described above, in addition to the bending strength, the image fixing ability and the mechanical strength, such as resistance to image breaking (image cracking) or detachment may also be improved in the white toner according to this exemplary embodiment.

The details of the white toner according to this exemplary embodiment are described.

The white toner according to this exemplary embodiment specifically includes, for example, white toner particles containing a binder resin, a white pigment, a release agent, and other additive(s) as needed and one or more external additives as needed.

First, the white pigment is described.

Regarding the white pigment, at least two types of a first white pigment and a second white pigment are used together.

The first white pigment is a white pigment having a specific gravity D1 satisfying a condition of $3.5<D1<6.0$, preferably a condition of $3.5<D1<5.0$, and more preferably a condition of $3.5<D1<4.5$.

When the specific gravity D1 of the first white pigment is 3.5 or less, the difference between the specific gravity D1 of the first white pigment and the specific gravity D2 of the second white pigment decreases. Accordingly, the effect of suppressing the local aggregation of the first white pigment due to the second white pigment, and evenly dispersing all of the white pigments in the white toner image, may not be obtained. When the specific gravity D1 of the first white pigment is 6.0 or more, the specific gravity of the first white pigment may be excessively great. Accordingly, even when the second white pigment having a specific gravity smaller than that of the first white pigment is used, the effect of suppressing the local aggregation of the first white pigment due to the second white pigment, and evenly dispersing all of the white pigments in the white toner image, may not be obtained.

When the specific gravity of the first white pigment satisfies the above-mentioned range, the specific gravity difference between the first white pigment and the second white pigment may be ensured and the local aggregation of the first white pigment may be suppressed due to the second white pigment. Accordingly, it is thought that the entire white pigments may be evenly dispersed in the white toner image.

The second white pigment is a white pigment having a specific gravity D2 satisfying a condition of $0.3<D2<1.2$, preferably a condition of $0.3<D2<1.0$, and more preferably a condition of $0.3<D2<0.8$.

When the specific gravity D2 of the second white pigment is 0.3 or less, the specific gravity of the second white pigment may be excessively small and thus the second white pigment may be unevenly distributed. When the specific gravity D2 of the second white pigment is 1.2 or more, the specific gravity of the second white pigment may become greater than the specific gravity of the binder resin and thus the dispersibility of the white pigments may decrease.

It is thought that, when the specific gravity of the second white pigment satisfies the above-mentioned range, the specific gravity difference between the first white pigment and the second white pigment may be ensured, the uneven distribution of the second white pigment may be suppressed, the local aggregation of the first white pigment may be suppressed due to the second white pigment, and all of the white pigments may be evenly dispersed in the white toner image.

The total content of the first white pigment and the second white pigment contained in the white toner according to this exemplary embodiment is in the range of from 20% by weight to 50% by weight. When the total content of the white pigments is less than 20% by weight, the concealment properties of the white toner or the dispersibility of the white pigment may be insufficient. When the total content of the white pigments is greater than 50% by weight, the ratio of the binder resin contained in the toner may decrease, whereby the strength of the fixed image may decrease. The total content of the white pigments is preferably in the range of from 30% by weight to 45% by weight.

The content ratio (first white pigment:second white pigment) of the first white pigment and the second white pigment may be in the range of from 1:1 to 4:1 in terms of weight ratio, preferably in the range of from 1:1 to 3:1, and more preferably in the range of from 1:1 to 2:1.

In this exemplary embodiment, it is preferable that the content of the first white pigment is greater than the content of the second white pigment. When the content of the first white pigment is greater than the content of the second white pigment, it is possible to obtain a white toner image with high coloring power and concealment power.

The content of the first white pigment may be selected from the range of from 10% by weight to 30% by weight (preferably the range of from 15% by weight to 30% by weight and more preferably the range of from 20% by weight to 30% by weight). When the content of the first white pigment is 10% by weight or more, it is possible to obtain the sufficient concealment property. When the content of the first white pigment is 30% by weight or less, it is not necessary to increase the amount of the second white pigment to maintain the dispersibility of the first white pigment and the decrease in strength of the fixed image due to the decrease in the ratio of the binder resin in the toner is less likely to be caused.

The content of the second white pigment may be selected from the range of from 10% by weight to 30% by weight (preferably the range of from 10% by weight to 25% by weight and more preferably the range of from 10% by weight to 20% by weight). When the content of the second white pigment is 10% by weight or more, it is possible to maintain the sufficient dispersibility of the second white pigment. When the content of the second white pigment is 30% by weight or less, it is possible to obtain the sufficient concealment property. Accordingly, it is not necessary to increase the amount of the first white pigment to maintain the concealment property and the decrease in strength of the fixed image due to the decrease in the ratio of the binder resin in the toner is less likely to be caused.

The specific gravity means the values measured using the following methods.

The specific gravity is measured as follows on the basis of 5-2-1 of JIS-K-0061 using a Le Chaterlier's pycnometer.

(1) 250 mL of ethyl alcohol is injected into the Le Chaterlier's pycnometer and is adjusted so that the meniscus thereof is located at the position of a scale mark.

(2) The pycnometer is immersed in a constant-temperature water tank and the position of the meniscus is accurately read from the scale marks of the pycnometer when the liquid temperature is 20.0±0.2° C. (with precision of 0.0025 mL).

(3) A sample of 100 g is measured and taken.

(4) The measured and taken sample is placed into the pycnometer and bubbles are removed therefrom.

(5) The pycnometer is immersed in the constant-temperature water tank, and the position of the meniscus is accurately read from the scale marks of the pycnometer when the liquid temperature is 20.0±0.2° C. (with precision of 0.0025 mL).

(6) The specific gravity is calculated using the following expressions.

Expression: $D=W/(L2-L1)$

Expression: $S=D/0.9982$

In the expressions, D represents the density (g/cm$^3$, 20° C.) of the sample, S represents the specific gravity (20° C.) of the sample, W represents the apparent mass (g) of the sample, L1 represents the read value of the meniscus (mL, 20° C.) before the sample is placed into the pycnometer, L2 represents the read value of the meniscus (mL, 20° C.) after the sample is placed into the pycnometer, and 0.9982 represents the density of water (g/cm$^3$) at 20° C.

The specific gravity is controlled depending on the composition (materials) type or structure of the white pigment.

The first white pigment is not particularly limited as long as it satisfies the above condition of specific gravity. Examples thereof include inorganic pigments (such as titanium dioxide, barium sulfate, zinc oxide, lead titanate, potassium titanate, barium titanate, strontium titanate, zirconium oxide, antimony trioxide, white lead, zinc sulfide, or barium carbonate). Among these, preferable examples include titanium dioxide, barium sulfate, and zinc oxide, and more preferable examples include titanium dioxide.

The second white pigment is not particularly limited as long as it satisfies the above condition of specific gravity. Examples thereof include organic pigments (such as polystyrene resin particles, urea formalin resin particles, polyacryl resin particles, polystyrene/acryl resin particles, polystyrene/butadiene resin particles, or alkyl bismelamine resin particles) and atypical particles (such as flattened resin particles, particulate-aggregating particles, erythrocytic resin particles, through-hole-type resin particles, or hollow particles). Particularly, the pigment having a hollow structure may be preferably used. Since the pigment having a hollow structure is a pigment may easily satisfy the above condition of specific gravity and may have high coloring power and concealment power, it is possible to obtain the white toner image with high coloring power and concealment power by using the pigments. It is thought that the reason is that a pigment having a hollow structure includes a shell portion and a hollow portion, the refractive index of the boundary surface between the shell portion and an air layer may be greater than that of the pigment having a non-hollow structure, whereby the coloring power and the concealment power may increase.

Examples of the pigment having a hollow structure include hollow inorganic pigments (such as hollow silica, hollow titanium dioxide, hollow calcium carbonate, hollow zinc oxide, or zinc oxide tube particles) and hollow organic particles (such as styrene resin, acryl resin, styrene/acryl resin, styrene/acrylic ester/acrylic acid resin, styrene/butadiene resin, styrene/methyl methacrylate/butadiene resin, ethylene/vinyl acetate resin, acryl/vinyl acetate resin, or acryl/maleic acid resin). Among these, the hollow inorganic particles (particularly, hollow silica) have high coloring power and high concealment power and may be easily made into a flattened shape when a pressure (for example, a pressure based on the fixing) is added, whereby the gloss of the obtained white toner image may be improved.

A white pigment (also referred to as "third white pigment") other than the first white pigment and the second white pigment may be used as a white pigment. The third white pigment can be used to such an extent that the advantage of use of the first white pigment and the second white pigment together is not hindered. Examples thereof include heavy calcium carbonate, light calcium carbonate, aluminum hydroxide, satin white, talc, calcium sulfate, magnesium oxide, magnesium carbonate, amorphous silica, colloidal silica, white carbon, kaolin, fired kaolin, delaminated kaolin, aluminosilicate, sericite, bentonite, and smectite.

The volume-average particle diameters of the first white pigment and the second white pigment are preferably 1 μm or less and more preferably in the range of from 100 nm to 300 nm.

The volume-average particle diameter is measured using a laser diffraction type particle size distribution measuring instrument (LA-700, trade name, made by HORIBA Co., Ltd.). In measurement, a sample in a dispersion liquid state is adjusted to be 2 g in solid and ion-exchange water is added thereto to made 40 mL. The resultant is introduced into a cell up to a proper concentration, is held for 2 minutes, and is then measured when the concentration of the cell has been stabilized. The obtained volume-average particle diameter of each channel is accumulated from the smallest side, and the value when it reaches 50% in accumulation is used as the volume-average particle diameter.

The binder resin is described.

Examples of the binder resin include an amorphous resin. A combination of an amorphous resin and a crystalline resin may be used.

The content of the amorphous resin with respect to components constituting the white toner particles may be in the range of from 50% by weight (or about 50% by weight) to 80% by weight (or about 80% by weight). When the amorphous resin is used together with the crystalline resin, the content of the crystalline resin with respect to the components constituting the white toner particles may be in the range of from 5% by weight to 30% by weight.

The "crystalline resin" means a resin having a clear endothermic peak, not a step-like endothermic variation, in a differential scanning calorimetry (DSC).

Specifically, it means that the half-value width of the endothermic peak is 6° C. or less when it is measured at a temperature-rising rate of 10° C./min. On the other hand, a resin of which a half-value width is greater than 6° C. or a resin of which the endothermic peak is not clearly observed means an amorphous resin. The resin of which the endothermic peak is not clearly observed may be used as the amorphous resin used in this exemplary embodiment.

The crystalline resin is not particularly limited as long as it is a resin having a crystalline property. Specific examples thereof include a crystalline polyester resin and a crystalline vinyl resin. The crystalline polyester resin is preferable and an aliphatic crystalline polyester resin is more preferable.

Polyester resins, such as crystalline polyester resins, may be synthesized, for example, from a polyvalent carboxylic acid component and a polyhydric alcohol component.

A commercially available product may be used as the polyester resin or a synthesized product may be used as the polyester resin.

The method of producing a crystalline polyester resin is not particularly limited. The crystalline polyester resin can be produced using a known polyester polymerization method of causing an acid component and an alcohol component to react. Examples thereof include a direct polycondensation method and an ester exchange method. The method of producing a crystalline polyester resin may be selected from these methods depending on the types of monomers.

The crystalline polyester resin may be produced in the range of polymerization temperature of from 180° C. to 230° C. The reaction system may be depressurized as needed and the reaction may be performed while removing water or alcohol generated at the time of condensation. When the monomers are not dissolved or are not compatible at the reaction temperature, a solvent with a high boiling point may be added as a solubilizing agent to dissolve the monomers. The polycondensation reaction is made while dissolving the solubilizing agent. When a monomer having poor compatibility exists in the polycondensation reaction, the monomer having poor compatibility and the acid or alcohol to be poly-condensed with the monomer may be condensed in advance and may then be poly-condensed with the main component.

The melting temperature of the crystalline resin is preferably in the range of from 50° C. to 100° C. and more preferable in the range of from 60° C. to 80° C.

The melting temperature of the crystalline resin means a value calculated as a peak temperature of the endothermic peak obtained in the differential scanning calorimetry (DSC). The crystalline resin may have plural melting peaks, and the maximum peak thereof is considered as the melting temperature in this exemplary embodiment.

Examples of the amorphous resin include known resin materials, and amorphous polyester resins can be preferably used. The amorphous polyester resins can be obtained from the polycondensation reaction of a polyvalent carboxylic acid and a polyhydric alcohol.

The polyester resin may be produced by poly-condensing a polyhydric alcohol and a polyvalent carboxylic acid using a typical method. For example, the polyhydric alcohol, the polyvalent carboxylic acid, and a catalyst as needed are blended in a flask having a thermometer, a stirrer, and a falling condenser, the resultant is heated up to the temperature of from 150° C. to 250° C. under the presence of an inert gas (nitrogen gas or the like), low-molecular compounds as by-products are continuously removed from the reaction system, the reaction is stopped when the acid value has reached a specific value, and the resultant is cooled, whereby a target reaction product is obtained.

Here, the amorphous resin preferably has a weight-average molecular weight (Mw) of from 5,000 (or about 5,000) to 1,000,000 (or about 1,000,000) when the molecular weight is measured by a gel permeation chromatography (GPC) of tetrahydrofuran (THF) solubles, and more preferably a weight-average molecular weight of from 7,000 to 500,000. The number-average molecular weight (Mn) thereof is preferably in the range of 2,000 to 10,000. The molecular weight distribution Mw/Mn is preferably in the range of from 1.5 to 100 and more preferably in the range of from 2 to 60.

The weight-average molecular weight is obtained by measuring a THF soluble with the THF solvent using GPC HLC-8120 (trade name, made by TOSOH CORPORATION) and COLUMN TSKgel SUPER HM-M (15 cm) (trade name, made by TOSOH CORPORATION) and calculating on the basis of a molecular weight correcting curve prepared using a monodispersed polystyrene standard sample.

The glass-transition temperature of the amorphous resin is preferably in the range of from 35° C. (or about 35° C.) to 100° C. (or about 100° C.) and more preferably in the range of from 50° C. to 80° C.

The glass-transition temperature of the amorphous resin is calculated by the peak temperature of the endothermic peak obtained by the differential scanning calorimetry (DSC).

The softening point of the amorphous resin is preferably in the range of from 80° C. to 130° C. and more preferably in the range of from 90° C. to 120° C.

The softening point of the amorphous resin means a middle temperature between a melting start temperature and a melting end temperature under the conditions of a pre-heating rate of 80° C./300 sec, a plunger pressure of 0.980665 MPa, a die size of 1 mmϕ×1 mm, and a temperature-raising rate of 3.0° C./min, by the use of a flow tester (CFT-500C, trade name, made by Shimadzu Corporation).

The release agent is described.

The content of the release agent with respect to components constituting of the white toner particles is preferably in the range of from 1% by weight (or about 1% by weight) to 10% by weight (or about 10% by weight) and more preferably in the range of from 2% by weight to 8% by weight.

Materials of which the main peak measured in accordance with ASTMD3418-8, the disclosure of which is incorporated by reference herein, is in the range of from 50° C. (or about 50° C.) to 140° C. (or about 140° C.) can be preferably used as the release agent.

For example, DSC-7 (trade name, made by PerkinElmer Co., Ltd.) is used to measure the main peak. The melting points of indium and zinc are used to correct the temperature of the detection unit of the instrument, and the melting heat of indium is used to correct the amount of heat. An aluminum pan is used for a sample, an empty pan is set for reference, and the measurement is made at a temperature-raising rate of 10° C./min.

The viscosity η1 of the release agent at 160° C. may be in the range of from 20 cps (or about 20 cps) to 600 cps (or about 600 cps).

Examples of the release agent include low-molecular-weight polyolefins such as polyethylene, polypropylene, or polybutene; silicones having a softening point by heat, fatty acid amides such as oleic amide, elcaic amide, ricinoleic amide, or stearic amide; plant wax such as carnauba wax, rice wax, candelilla wax, Japan wax, or jojoba wax; animal wax such as bees wax; minerals such as montan wax, ozokerite, ceresin, paraffin wax, microcrystalline wax, or Fisher-Tropsch wax; petroleum wax; and modified products thereof.

In this exemplary embodiment, the release agent contains a metal salt. The content of the metal salt contained in the release agent is not particularly limited, but is preferably in the range of from 0.1 atom % (or about 0.1 atom %) to 1.5 atom % (or about 1.5 atom %) and more preferably in the range of from 0.2 atom % to 1.0 atom %. The type of the metal salt is not particularly limited, but is preferably a metal salt including an element of Group I of the Periodic Table or an element of Group II of the Periodic Table.

Examples of the metal salt include metal salts of acid such as those of hydrochloric acid, sulfuric acid, nitric acid, acetic acid, or oxalic acid, metal salts of inorganic acid such as magnesium chloride, sodium chloride, calcium sulfate, ammonium sulfate, silver nitrate, copper sulfate, sodium carbonate, or sodium hydrogen carbonate, metal salts of aliphatic acid or aromatic acid such as sodium acetate, potassium formate, sodium oxalate, sodium phthalate, or potassium salicylate, metal salts of phenol such as sodium phenolate, metal salts of amino acid, inorganic acid salts of aliphatic or aromatic amine such as triethanolamine hydrochloride or aniline hydrochloride, poly aluminum chloride, aluminum sulfate, highly-basic poly aluminum chloride (BAC), poly aluminum hydroxide, and aluminum chloride. Among these, sodium chloride, sodium carbonate, and sodium hydrogen carbonate are preferable and sodium chloride is more preferable.

It is checked by the following method whether sodium is contained in the release agent domain.

First, the toner particles are embedded using bisphenol A type liquid epoxy resin and a curing agent, and then a cutting sample is produced. The cutting sample is cut at −100° C. using a cutter employing a diamond knife, for example, LEICA ULTRA MICROTOME (trade name, made by HITACHI Technologies Corporation) to obtain an observing sample. The observing sample is placed in a desiccator in the atmosphere of ruthenium tetroxide to dye the sample. The dying state is determined on the basis of the dyed state of a tape placed at the same time. The thus died observing sample is observed at a magnification ratio of 5,000 using a TEM.

Since the toner sample is dyed with ruthenium tetroxide, the domain of the binder resin (a domain other than the release agent domain) or the domain of the release agent (release agent domain) is determined on the basis of the shading difference of the dying or the shape thereof. A portion existing in a rod shape or a lump shape in the toner and having white contrast is determined as the release agent domain.

The amount of sodium in the release agent domain is measured by mapping the observing sample with an acceleration voltage of 20 kV using an energy dispersive X-ray analyzer EMAX MODEL 6923H (trade name, made by HORIBA Corporation) mounted on an electron microscope S4100.

Other additives are described.

Examples of other additives include various components such as internal additive, charging control agent, inorganic powder (inorganic particles), or organic particles.

Examples of the internal additive include magnetic materials such as metals of ferrite, magnetite, reduced iron, cobalt, manganese, nickel, and the like, alloys, or compounds containing the metals.

Examples of the inorganic particles include known inorganic particles such as silica particles, titanium dioxide particles, alumina particles, cerium oxide particles, or particles obtained by hydrophobizing the surfaces thereof. The inorganic particles may be subjected to various surface treatments, for example, using a silane coupling agent, a titanium coupling agent, or a silicon oil.

The external additive is described.

For example, inorganic particles can be used as the external additive. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SO_2$, $CaCO_3$, $MgCO_3$, $BaSO_4$, and $MgSO_4$.

The surface of the external additive may be subjected to a hydrophobizing process in advance. The powder fluidity of the white toner particles may be improved by the hydrophobizing process, and the dependency of the charging on the environment and the carrier contamination resistance may be effectively improve. The hydrophobizing process is performed, for example, by immersing the inorganic particles in a hydrophobizing agent. The hydrophobizing agent is not particularly limited, and examples thereof include a silane coupling agent, a silicon oil, a titanate coupling agent, and an aluminum coupling agent. These additives may be used singly or in combination of two or more types.

The amount of the external additive to be externally added is preferably in the range of from 0.5 parts by weight to 2.5 parts by weight with respect to 100 parts by weight of the white toner particles.

Characteristics of the white toner particles are described.

The volume-average particle diameter of the white toner particles is preferably in the range of from 4 μm (or about 4 μm) to 9 μm (or about 9 μm).

The volume-average particle diameter is measured with COULTER MULTISIZER (trade name, made by Coulter Inc.) using an aperture diameter of 50 μm. The measurement is performed after the toner is dispersed in an electrolyte solution (ISOTON solution) using ultrasonic waves for 30 seconds or more.

The white toner according to the exemplary embodiment is preferably spherical in which the shape factor SF1 is preferably in the range of from 115 (or about 115) to 140 (or about 140). The shape of toner particles is preferably spherical from the view point of developing property and transfer efficiency. However, the spherical toner may sometimes be inferior in cleaning property to irregular shape toner. When the shape factor is in the above-mentioned range, transfer efficiency and image denseness may improve, and thus a high quality image may be formed and cleaning of the photoreceptor surface may be improved.

The shape factor SF1 is more preferably in the range of from 120 to 138.

Here, the shape factor SF1 is determined by Equation (1).

$$SF1=(ML^2/A)\times(\pi/4)\times100 \quad \text{Equation (1)}$$

In Equation (1), ML represents the absolute maximum length of the toner and A represents a projection area of the toner, respectively.

The SF1 is digitized mainly by analyzing a microscopic image or a scanning electron microscopic (SEM) image using an image analyzer and is calculated, for example, in a manner as described below. More specifically, optical microscopic images of particles scattered on the surface of a slide glass are taken into a Luzex image analyzer through a video camera to determine the maximum length and the projection area of the particles of 100 or more. Then, the SF1 is calculated according to Equation (1) and is determined as the average value thereof.

A method for producing the white toner according to the exemplary embodiment is not particularly limited, and the toner may be produced by a known dry type method, such as a kneading•pulverization method or a known wet type method, such as an emulsion aggregation method or a suspension polymerization method. Among these methods, an emulsion aggregation method allowing easy production of a toner having a core shell structure is preferable. Hereinafter, a method for producing the toner according to the exemplary embodiment by an emulsion aggregation method is described in detail.

The emulsion aggregation method according to the exemplary embodiment includes emulsifying raw materials used in the toner to form resin particles (emulsion particles) (emulsifying process), forming an aggregate of the resin particles (aggregation process), and coalescing the aggregate (coalescence process).

Emulsifying Process

A resin particle dispersion liquid may be produced by, for example, applying shearing force with a disperser to a solution in which a water-based medium and a binder resin are mixed. In this case, particles may be formed by reducing the viscosity of a resin component by heating. For stabilization of the dispersed resin particles, a dispersant may be used. When an oil based resin is used and the resin dissolves in a solvent whose solubility in water is relatively low, a resin particle dispersion liquid can be produced by dissolving the resin in the solvents, which is then dispersed in a particle manner in water together with a dispersant or a polymer electrolyte, and then the solvent is evaporated from the resultant mixture by heating or reducing the pressure, whereby the resin particle dispersion liquid is obtained.

Examples of the water-based medium include water, such as distilled water or ion-exchanged water; and alcohols, and the water-based medium is preferably water.

Examples of a dispersant for use in the emulsifying process include water-soluble polymers, such as polyvinyl alcohol, methylcellulose, ethyl cellulose, hydroxyethylcellulose, carboxymethylcellulose, sodium polyacrylate, or sodium polymethacrylate; surfactants, such as anionic surfactants, such as sodium dodecylbenzenesulfonate, octadecylsodium sulfate, sodium oleate, sodium laurylate, or potassium stearate, cationic surfactants, such as lauryl amine acetate, stearylamine acetate, or lauryl trimethyl ammoniumchloride, amphoteric ionic surfactants, such as lauryldimethyl amine oxide, nonionic surfactants, such as polyoxyethylene alkyl ether, polyoxyethylene alkyl phenyl ether, or polyoxyethylene alkylamine; and inorganic salts, such as tricalcium phosphate, aluminum hydroxide, calcium sulfate, calcium carbonate, or barium carbonate.

Examples of a dispersing machine for use in the production of the emulsified liquid include a homogenizer, a homomixer, a pressurizing kneader, an extruder, and a media dispersing machine. As the size of the resin particles, the average particle diameter (volume average particle diameter thereof) is preferably 1.0 μm or lower, more preferably in the range of from 60 nm to 300 nm, and still more preferably in the range of from 150 nm to 250 nm. When the average particle diameter is lower than 60 nm, the resin particles may be stable in the dispersion liquid. Therefore, aggregation of the resin particles may becomes difficult in some cases. When the average particle diameter exceeds 1.0 μm, the aggregation properties of the resin particles may improve, whereby toner may be more easily produced; however, a particle size distribution of the toner may become wider in some cases.

For preparation of a release agent dispersion liquid, a release agent and a metal salt is dispersed in water together with an ionic surfactant or a polymer electrolyte, such as a polymeric acid or a polymeric base, and then the resultant mixture is heated to a temperature equal to or higher than the melting point of the release agent and dispersed using a homoginizer or a pressure-discharge-type dispersing machine capable of applying a strong shearing force. The release agent dispersion liquid can be obtained through this treatments. The release agent dispersion liquid is used for an emulsion aggregation method, and also may be used for producing a toner by a suspension-polymerization method.

By the dispersion treatment, the release agent dispersion liquid containing release agent particles having a volume average particle diameter of 1 μm or lower may be obtained. A more preferable volume average particle diameter of the release agent particles is from 100 nm to 500 nm.

When the volume average particle diameter is lower than 100 nm, the release agent component may generally become hard to be incorporated into a toner, depending on the properties of the binding resin to be used. When the volume average particle diameter exceeds 500 nm, the dispersion state of the release agent in the toner becomes insufficient in some cases.

The white pigment dispersion liquid is produced using known dispersion methods. When producing the white pigment dispersion liquid, a general dispersion instrument such as a rotary-shearing homogenizer, a ball mill having a medium, a sand mill, a dyno mill, or an ultimizer, may be employed without particular limitation. The white pigments are dispersed in water along with an ionic surfactant or a polymer electrolyte such as a polymer acid or a polymer base. The volume-average particle diameter of the dispersed white pigment particles may be 1 μm or less. When the volume-average particle diameter is in the range of from 80 nm to 500 nm, the aggregation property may be less likely to be damaged and excellent dispersion of the white pigment in the toner may be attained.

Aggregation Process

In the aggregation process, the resin particle dispersion liquid, the white pigment dispersion liquid, the release agent dispersion liquid, etc., are mixed to be used as a mixed liquid, and the mixed liquid is heated at a temperature equal to or lower than the glass transition temperature of the resin particles for aggregation to form aggregated particles. The aggregated particles may be formed by, for example, making the pH of the mixed liquid acidic under stirring in many cases. The pH is preferably in the range of from 2 to 7, and, in this case, the use of an aggregating agent may be effective.

In the aggregation process, the release agent dispersion liquid may be added and mixed at once together with various dispersion liquids, such as a resin particle dispersion liquid, or may be divided into several portions and added in a divided manner.

As the aggregating agent, a surfactant having a polarity reverse to that of the surfactant for use in the dispersant, an inorganic metal salt, or a di- or higher valent metal complex may be preferably used. Particularly when a metal complex is used, the used amount of the surfactant can be reduced and chargeability improves, and thus the use thereof is preferable.

Preferable examples of the inorganic metal salt include an aluminum salt and polymers thereof. In order to obtain a narrower particle size distribution, divalent inorganic metal salts are more preferable than monovalent metal salts, trivalent inorganic metal salts are more preferable than divalent inorganic metal salts, tetravalent inorganic metal salts are more preferable than trivalent inorganic metal salts, and for those having the same valency, an inorganic metal salt polymer is more preferable.

In the exemplary embodiment, it is preferable to use a polymer of tetravalent inorganic metal salt containing aluminum for obtaining a narrow particle size distribution.

By additionally adding the resin particle dispersion liquid when the particle diameter of the aggregated particles reach a desired particle diameter (coating process), a toner having a structure in which the surface of the core aggregated particles are covered with a resin may be produced. In this case, the release agent and the colorant (white pigment) may be less likely to be exposed to the surface of a toner. Therefore, such a structure is preferable from the viewpoint of chargeability or development properties. When the resin particle dispersion liquid is additionally added, an aggregating agent may be added or the pH may be adjusted before the additionally adding of the resin particle dispersion.

Coalescence Process

In the coalescence process, the progress of aggregation is stopped by increasing the pH of a suspension of aggregated particles to be in the range of from 3 to 9 under stirring conditions according to the aggregation process, and the aggregated particles are coalesced by heating at a temperature equal to or higher than the glass transition temperature of the resin. When covered with the resin, the resin is also coalesced to cover the core aggregated particles. The heating may be performed so that coalescence may be effected, and may be performed for from 0.5 hour to 10 hours.

The resultant mixture is cooled after coalescence, and coalesced particles are obtained. In the cooling process, near the glass transition temperature of the resin (in the range of ±10° C. of the glass transition temperature) the cooling rate may be reduced, i.e., the mixture is gradually cooled so that crystallization may be accelerated.

The coalesced particles obtained by coalescence can be formed into toner particles through a solid-liquid separation process, such as filtration, and, as required, a washing process and a drying process.

An example of the method of externally adding an external additive to the toner particles include a method of adding an external additive to the toner particles and mixing the resultant with a known mixer such as a V-shaped blender, a HENSCHEL mixer, or Loedige mixer.

As the release agent, a hydrophobic material such as hydrocarbon is often used. Accordingly, when the toner is produced using a wet production method, the release agent component is easily unevenly distributed in the toner particles so as to avoid a water-based medium. By containing a metal salt in the release agent, the hydrophilic property of the release agent may be improved and the release agent can easily exist in the vicinity of the surfaces of the toner particles.

Electrostatic Charge Image Developer

An electrostatic charge image developer according to the exemplary embodiment at least contains the white toner according to the exemplary embodiment.

The electrostatic charge image developer according to the exemplary embodiment may be a one-component developer including only the white toner according to the exemplary embodiment. Alternatively, the electrostatic charge image developer according to the exemplary embodiment may be a two-component developer including the white toner according to the exemplary embodiment and a carrier in combination.

A carrier usable for a two component developer is not limited, and any of known carriers may be used. Examples of the carrier include magnetic metals, such as iron oxide, nickel, and cobalt, magnetic oxides, such as ferrite and magnetite, resin coated carriers having a resin coating layer on the surface of the core materials, and magnetic dispersed carriers. Examples of the carrier further include resin-dispersed carriers in which an electro-conductive material or the like is dispersed in a matrix resin.

Examples of the coating resins or matrix resins for use in the carriers include, but not limited thereto, polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymers, styrene-acrylic acid copolymers, straight silicone resins containing an organosiloxane bond or modified products thereof, fluororesins, polyesters, polycarbonates, phenol resins, and epoxy resins.

Examples of the electro-conductive materials include, but not limited thereto, metals, such as gold, silver, and copper, carbon black, titanium dioxide, zinc oxide, barium sulfate, aluminum borate, potassium titanate, tin oxide, and carbon black.

Examples of the carrier core material include magnetic metals, such as iron, nickel, and cobalt, magnetic oxides, such as ferrite and magnetite, and glass beads. In order to use the carrier for a magnetic brush method, the carrier core material is preferably a magnetic material.

The volume average particle diameter of the carrier core material may be generally in the range of from 10 μm to 500 μm and is preferably in the range of from 30 μm to 100 μm.

Examples of the method for coating the surface of the carrier core material with a resin include a method which involves coating the carrier core material with a coating layer-forming solution, in which the above coating resin, and, as required, various additives, are dissolved in an appropriate solvent. The solvent is not limited, and may be selected considering the coating resin to be used, ease of application, etc.

Specific examples of resin coating methods include immersion methods in which the carrier core material is immersed in a coating layer-forming solution, spray methods in which a coating layer-forming solution is sprayed onto the surface of the carrier core material, fluidized bed methods in which a coating layer-forming solution is atomized while the carrier core material is maintained in a floating state using an air flow, and kneader coater methods in which the carrier core material and a coating layer-forming solution are mixed in a kneader coater, and the solvent is then removed.

As the mixing ratio (weight ratio) between the toner according to the exemplary embodiment and the carrier in the two-component developer described above, a toner: carrier ratio is preferably from approximately 1:100 to 30:100 and more preferably from approximately 3:100 to 20:100.

Toner Cartridge, Process Cartridge, and Image Forming Apparatus

The image forming apparatus according to this exemplary embodiment includes a first image forming unit that forms a white toner image formed from a white toner according to this exemplary embodiment on a transfer medium and a second image forming unit that forms a color image formed from one or more color toners for electrostatic charge image development on the transfer medium.

The first and second image forming units of the image forming apparatus according to this exemplary embodiment may each include, for example, a latent image holding member, a developing unit that develops an electrostatic charge image formed on the latent image holding member into a toner image using a toner, a transfer unit that transfers the toner image formed on the latent image holding member onto a transfer medium, and other units such as a cleaning unit that cleans the transfer residual component from the latent image holding member as needed, and further may include a fixing unit that fixes the toner image (the white toner image and the color image) transferred onto the transfer medium. The first and second image forming units may be configured to commonly use the image holding member or the transfer unit.

The image forming apparatus according to this exemplary embodiment may be, for example, an image forming apparatus sequentially repeating a primary transfer of toner images formed on a latent image holding member to an intermediate transfer medium or a tandem-type image forming apparatus in which plural latent image holding members having color developing units are arranged in tandem on an intermediate transfer medium.

In the image forming apparatus according to this exemplary embodiment, for example, a part including the developing unit that stores the electrostatic charge image developer according to this exemplary embodiment may have a cartridge structure (process cartridge) and can be attachable to and detachable from the image fanning apparatus, or a part that stores the white toner for electrostatic charge image development according to this embodiment as a replenishing toner supplied to the developing unit may have a cartridge structure (toner cartridge) and can be attachable to and detachable from the image forming apparatus.

Hereinafter, the image forming apparatus according to the exemplary embodiment is described with reference to the drawings.

FIG. 1 is a schematic configuration diagram illustrating an example of the image forming apparatus according to the exemplary embodiment. The image forming apparatus shown in FIG. 1 is one example of the exemplary embodiment and relates to a tandem type structure in which plural photoreceptors as a latent image holding member, i.e., plural image forming units, are provided.

In the image forming apparatus according to the exemplary embodiment, four image forming units 50Y, 50M, 50C, and 50K for forming images of respective colors of yellow, magenta, cyan, and black, respectively and an image forming unit 50W forming a white toner image are disposed at intervals in parallel (in the form of tandem) as illustrated in FIG. 1. The image forming units 50W, 50Y, 50M, 50C, and 50K are disposed in this order from the downstream side of the rotation direction of the intermediate belt 33.

Here, the respective image forming units 50Y, 50M, 50C, 50K, and 50W have the similar structure except the color of a toner in a developer contained in each unit, and thus the description is given to the image forming unit 50Y for forming a yellow image as a typical example. The descriptions of the image forming units 50M, 50C, 50K and 50W are omitted by giving reference numerals designating magenta (M), cyan (C), black (K), and white (W) instead of yellow (Y), to portions equivalent to those of the image forming unit 50Y. In the exemplary embodiment, the toner according to the exemplary embodiment is used as a toner (white toner) in a developer contained in the image forming unit 50W.

The yellow image forming unit 50Y has a photoreceptor 11Y as a latent image holding member. The photoreceptor 11Y is configured to rotate at a given process speed by a driving unit (not illustrated) along the direction of arrow A in FIG. 1. As the photoreceptor 11Y, an organic photoreceptor having sensitivity in an infrared region is used, for example.

A charging roll (charging unit) 18Y is provided on the upper portion of the photoreceptor 11Y. To the charging roll 18Y, a given voltage is applied by a power source (not illustrated), and the surface of the photoreceptor 11Y is charged to a given potential.

At the periphery of the photoreceptor 11Y, an exposure device (electrostatic charge image forming unit) 19Y for exposing the surface of the photoreceptor 11Y to light to form an electrostatic latent image is disposed at the downstream side of the rotation direction of the photoreceptor 11Y relative to the charging roll 18Y. Here, as the exposure device 19Y, an LED array by which reduced size may be enabled is used in view of a space. However, the exposure device 19Y is not limited thereto, and an electrostatic latent image forming unit using another laser beam or the like may be used.

At the periphery of the photoreceptor 11Y, a developing device (developing unit) 20Y having a developer holder for holding a yellow color developer is disposed at the downstream side of the rotation direction of the photoreceptor 11Y relative to the exposure device 19Y, such that the electrostatic charge image formed on the surface of the photoreceptor 11Y is developed with a yellow color toner to form a toner image on the surface of the photoreceptor 11Y.

An intermediate transfer belt (primary transfer unit) 33 for primarily transferring the toner image formed on the surface of the photoreceptor 11Y is disposed under the photoreceptor 11Y in such a manner that the intermediate transfer belt is stretched under the five photoreceptors 11Y, 11M, 11C, 11K and 11W. The intermediate transfer belt 33 is pressed against the surface of the photoreceptor 11Y by the primary transfer roll 17Y. The intermediate transfer belt 33 is tensioned by three rolls, i.e., a driving roll 12, a support roll 13, and a biasing roll 14, and is configured to rotate in the direction of arrow B at a moving rate equal to the process speed of the photoreceptor 11Y. On the surface of the intermediate transfer belt 33, the yellow toner image is primarily transferred, and the toner images of respective colors of magenta, cyan, and black and white are successively primarily transferred so that the toner images are disposed as multiple layers on the intermediate transfer belt 33.

At the periphery of the photoreceptor 11Y, a cleaning device 15Y for cleaning a toner remaining on or re-transferred to the surface of the photoreceptor 11Y is disposed at the downstream side of the rotation direction (direction of arrow A) of the photoreceptor 11Y relative to the primary transfer roll 17Y. A cleaning blade in the cleaning device 15Y is attached in such a manner that the cleaning blade is in pressure-contact with the surface of the photoreceptor 11Y in a counter direction.

To the biasing roll 14 for tensioning the intermediate transfer belt 33, a secondary transfer roll (secondary transfer unit) 34 is disposed so as to be in pressure-contact with the biasing roll 14 through the intermediate transfer belt 33. The toner images that have been primarily transferred to the surface of the intermediate transfer belt 33 and are disposed thereon is electrostatically transferred to the surface of a recording paper (transfer object) P fed from a paper cassette (not illustrated) at the pressure-contact portion of the biasing roll 14 and the secondary transfer roll 34. In this case, among the toner images that have been transferred to and disposed on the intermediate transfer belt 33, the white toner image is located at the top (the uppermost layer), and thus among the toner images transferred to the surface of the recording paper P, the white toner image is located at the bottom (the bottom layer).

At the downstream side of the secondary transfer roll 34, a fixing device (fixing unit) 35 for fixing the toner images, which have been transferred as multiple layers onto the recording paper P, to the surface of the recording paper P by heat and a pressure to form a permanent image, is disposed.

Examples of the fixing device 35 include a belt-like fixation belt using a low surface energy material such as a fluororesin component or a silicone resin for the surface, and a cylindrical fixing roll using a low surface energy material such as a fluororesin component or a silicone resin for the surface.

Next, operation of each of the image forming units 50Y, 50M, 50C, 50K and 50W for forming images of respective colors of yellow, magenta, cyan, black and white are described. The operation of each of the image forming units 50Y, 50M, 50C, 50K and 50W is substantially the same, and thus the operation of the yellow image fowling unit 50Y are described as a typical example.

In the yellow developing unit 50Y, the photoreceptor 11Y rotates at a given process speed in the direction of arrow A. By the charging roll 18Y, the surface of the photoreceptor 11Y is minus-charged to a given potential. Thereafter, the surface of the photoreceptor 11Y is exposed to light by the exposure device 19Y, and then an electrostatic charge image in accordance with image information is formed. Subsequently, the toner that has been minus-charged is reverse-developed by the developing device 20Y, and the electrostatic charge image formed on the surface of the photoreceptor 11Y is visuallized on the surface of the photoreceptor 11Y, whereby a toner image is formed. Thereafter, the toner image on the surface of the photoreceptor 11Y is primarily transferred to the surface of the intermediate transfer belt 33 by the primary transfer roll 17Y. After primary transferring, remaining components after transfer, such as a toner remaining on the surface of the photoreceptor 11Y, are scratched by the cleaning blade of the cleaning device 15Y, and then the surface of the photoreceptor 11Y is cleaned. Then, the photoreceptor 11Y is ready for the following image forming processes.

The above operation is performed in each of the image forming units 50Y, 50M, 50C, 50K and 50W, and the toner image visualized on each of the photoreceptors 11Y, 11M, 11C, 11K and 11W is successively transferred to the surface of the intermediate transfer belt 33 so that multiple toner layers are disposed on the intermediate transfer belt. When forming images in a color mode, toner images of respective colors of yellow, magenta, cyan, black and white are transferred in the stated order so that multiple toner layers are disposed on the intermediate transfer belt. When forming images in a two-color mode or a three-color mode, the order is the same as above, and only toner images of required colors are transferred so that multiple toner layers or a single toner layer are disposed on the intermediate transfer belt. Thereafter, the toner images that have been transferred to the surface of the intermediate transfer belt 33 to form a single toner layer or multiple toner layers, are secondarily transferred to the surface of the recording paper P conveyed from the paper cassette (not illustrated) by a secondary transfer roll 34, and are then heated and pressurized in the fixing device 35 to be fixed. A toner remaining on the surface of the intermediate transfer belt 33 after secondary transfer is cleaned by a belt cleaner 16 including a cleaning blade for the intermediate transfer belt 33.

In the example shown in FIG. 1, the yellow image forming unit 50Y is configured as a process cartridge including the developing device 20Y including the developer holder for holding a yellow electrostatic charge image developer, the photoreceptor 11Y, the charging roll 18Y, and the cleaning device 15Y in one unit that is attachable to and detachable from the image forming apparatus main body. The image forming units 50W, 50K, 50C, and 50M are also configured as a process cartridge similarly as the image forming unit 50Y.

Each of the toner cartridges 40Y, 40M, 40C, 40K, and 40W is a cartridge that stores the corresponding color toner and that is attachable and detachable from the image forming apparatus, and is connected to the developing unit of the corresponding color via a toner supply pipe not shown. When almost the individual toner stored in each toner cartridge is used, the toner cartridge may be replaced.

EXAMPLES

This exemplary embodiment is described in detail with reference to examples, but this exemplary embodiment is not limited to the examples. As long as any particular description is not given, "parts" and "%" are based on weight in the following description.

Production of Polyester Resin 1 dimethyl adipate: 74 parts dimethyl terephthalate: 192 parts bisphenol A ethylene oxide adduct: 216 parts ethylene glycol: 38 parts tetrabutoxy titanate (catalyst): 0.037 parts The above components are introduced into a two-necked flask which has been heated and dried, nitrogen gas is introduced into the flask to maintain the inert gas atmosphere, the temperature is raised while stirring, and then a co-condensation polymerization reaction is made at 160° C. for 7 hours. Thereafter, the temperature is raised up to 220° C. while slowly lower the pressure to 10 Torr and this state is maintained for 4 hours. The pressure is once restored to the ordinary pressure, 9 parts of trimellitic anhydride is added thereto, the pressure is slowly lowered to 10 Torr again, and this state is maintained for 1 hour, whereby polyester resin 1 is synthesized.

As the measurement result of the glass-transition temperature using the above-mentioned method and the differential scanning calorimeter (DSC), the glass-transition temperature of polyester resin 1 is 65° C. As the measurement result of the molecular weight using the above-mentioned method by GPC, the weight-average molecular weight (Mw) of polyester resin 1 is 12,000 and the number-average molecular weight is 4,000.

Production of Polyester Resin Dispersion Liquid 1

Polyester resin 1 (Mw: 12,000): 160 parts ethyl acetate: 233 parts aqueous solution of sodium hydroxide (0.3 N): 0.1 parts The above components are introduced into a separable flask of 1000 mL, the flask is then heated at 70° C., and the contents thereof are stirred by the use of THREE ONE MOTOR (trade name, made by SHINTO SCIENTIFIC Co., Ltd.), whereby a resin mixture solution is produced. 373 parts of ion-exchange water is slowly added thereto while stirring the resin mixture solution, the resultant is emulsified, and the solvent is removed therefrom, whereby polyester resin dispersion liquid 1 (solid concentration: 30%) is obtained. The volume-average particle diameter of the resin particles in the dispersion liquid is 160 nm.

Production of Polyester Resin 2 bisphenol A ethylene oxide 2 mol adduct: 114 parts bisphenol A propylene oxide 2 mol adduct: 84 parts dimethyl terephthalate: 75 parts dodecenyl succinic acid: 19.5 parts trimellitic acid: 7.5 parts The above components are introduced into a flask with an internal capacity of 5 L having a stirrer, a nitrogen introduction pipe, a temperature sensor, and a rectifying column, the temperature is raised up to 190° C. for 1 hour, the reaction system is stirred, and then 3.0 parts of dibutyl tin oxide is introduced into the flask. The temperature is raised from 190° C. to 240° C. over 6 hours while distilling off generated water, and a dehydration and condensation reaction is continued at 240° C. for 2 hours, whereby polyester resin 2 is synthesized.

The glass-transition temperature of polyester resin 2 is 57° C., the acid value thereof is 15.0 mgKOH/g, the weight-average molecular weight is 58,000, and the number-average molecular weight is 5,600.

Production of Polyester Resin Dispersion Liquid 2

In substantially the same manner as that of polyester resin dispersion liquid 1 except that polyester resin 2 is used instead of polyester resin 1, polyester resin dispersion liquid 2 (solid concentration: 30%) is produced. The volume-average particle diameter of the resin particles in the dispersion liquid is 160 nm.

Production of First White Pigment Dispersion Liquid

Production of White Pigment Dispersion Liquid A1 rutile type titanium dioxide (CR-60-2, trade name, made by ISHIHARASANGYO KAISHA, LTD.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and are dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 210 nm is produced.

Production of White Pigment Dispersion Liquid A2 anatase titanium dioxide (A-220, trade name, made by ISHIHARASANGYO KAISHA, LTD.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and are dispersed with a high-pressure impact disperser ULTIMIZER (HP30006, trade name, made by SUGINO MACHINE LIMITED) for 1 hour, whereby a white pigment dispersion liquid (solid concentration: 30%) in which white pigment particles with a volume-average particle diameter of 160 nm is produced.

Production of White Pigment Dispersion Liquid A3 zinc oxide (SPECIAL NO. 1 ZINC OXIDE, trade name, made by Hakusui Tech Co., Ltd.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 330 nm is produced.

Production of White Pigment Dispersion Liquid A4 potassium titanate (TISMO D, trade name, made by Otsuka Chemical Co., Ltd.): 210 parts nonionic surfactant (NONIPOL 400, trade name, made by SANYOKASEI Co., Ltd.): 10 parts ion-exchange water: 480 parts The above components are mixed, are stirred using a homogenizer (ULTRA TURRAX T50, trade name, made by IKA Corporation) for 30 minutes, and are dispersed with a high-pressure impact disperser ULTIMIZER(HP30006, trade name, made by SUGINO MACHINE LIMITED) for 1 hour, whereby a white pigment dispersion liquid (solid concentration: 30%) in which white pigment particles with a volume-average particle diameter of 450 nm is produced.

Production of White Pigment Dispersion Liquid A5 white lead (DR-46000 KREMNITZ WHITE, trade name, made by Dr. KREMER): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 500 nm is produced.

Production of Second White Pigment Dispersion Liquid

Production of White Pigment Dispersion Liquid B1 hollow silica (SILINAX, trade name, made by Nittetsu Mining Co., Ltd.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 100 nm is produced.

Production of White Pigment Dispersion Liquid B2 hollow cross-linked styrenetacryl resin particles (SX866 (A), trade name, made by JSR Co., Ltd.): 210 parts nonionic surfactant (NONIPOL 400, trade name, made by SANYOKASEI Co., Ltd.): 10 parts ion-exchange water: 480 parts The above components are mixed, are stirred using a homogenizer (ULTRA TURRAX T50, trade name, made by IKA Corporation) for 30 minutes, and is dispersed with a high-pressure impact disperser ULTIMIZER (HP30006, trade name, made by SUGINO MACHINE LIMITED) for 1 hour, whereby a white pigment dispersion liquid (solid concentration: 30%) in which white pigment particles with a volume-average particle diameter of 300 nm is produced.

Production of White Pigment Dispersion Liquid B3

Carboxylic styrene-butadiene copolymer resin particles (LX407BP, trade name, made by NIPPON ZEON Corporation) are used. The volume-average particle diameter is 400 nm and the solid concentration is 50%.

Production of White Pigment Dispersion Liquid B4 silica (SP-03F, trade name, made by Fuso Chemical Co., Ltd.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 300 nm is produced.

Production of White Pigment Dispersion Liquid B5 hollow cross-linked styrene/acryl resin particles (SX8782 (P), trade name, made by JSR Co., Ltd.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 1,100 nm is produced.

Production of White Pigment Dispersion Liquid B6 ethylene melamine bis resin particles (SHIGENOX OWP, trade name, made by Hakkol Chemical Co., Ltd.): 210 parts nonionic surfactant (NONIPOL 400, trade name, made by SANYOKASEI Co., Ltd.): 10 parts ion-exchange water: 480 parts The above components are mixed, and the mixture is stirred using a homogenizer (ULTRA TURRAX T50, trade name, made by IKA Corporation) for 30 minutes, and is dispersed with a high-pressure impact disperser ULTIMIZER (HJP30006, trade name, made by SUGINO MACHINE LIMITED) for 1 hour, whereby a white pigment dispersion liquid (solid concentration: 30%) in which white pigment particles with a volume-average particle diameter of 500 nm is produced.

Production of Release Agent Particle Dispersion Liquid C1 polyethylene wax (PW655, trade name, made by Toyo Petrolite Co., Ltd., melting point of 97° C.): 50 parts anionic surfactant (NEOGEN RK, trade name, made by Dai-Ichi Kogyo Seiyaku Co., Ltd.): 1.0 parts sodium chloride (made by Wako Pure Chemical Industries, Ltd.): 5 parts Ion-exchange water: 200 parts The above components are mixed and the mixture is heated at 95° C. and is dispersed with a homogenizer (ULTRA TURRAX T50 made by IKA Corporation). Thereafter, the resultant is dispersed with MANTON-GAULIN HIGH-PRESSURE HOMOGENIZER (trade name, made by GAULIN Corporation) for 360 minutes, whereby release agent particle dispersion liquid C1 (solid concentration: 20%) in which release agent particles with a volume-average particle diameter of 0.23 μm are dispersed is produced.

Production of Release Agent Particle Dispersion Liquid C2

In substantially the same manner as that of release agent particle dispersion liquid C1 except that the amount of sodium chloride is changed to 1.8 parts, release agent particle dispersion liquid C2 is produced.

Production of Release Agent Particle Dispersion Liquid C3

In substantially the same manner as that of release agent particle dispersion liquid C1 except that the amount of sodium chloride is changed to 7.8 parts, release agent particle dispersion liquid C3 is produced.

Production of Release Agent Particle Dispersion Liquid C4

In substantially the same manner as that of release agent particle dispersion liquid C1 except that the amount of sodium chloride is changed to 1.3 parts, release agent particle dispersion liquid C4 is produced.

Production of Release Agent Particle Dispersion Liquid C5

In substantially the same manner as that of release agent particle dispersion liquid C1 except that the amount of sodium chloride is changed to 11.8 parts, release agent particle dispersion liquid C5 is produced.

Production of Release Agent Particle Dispersion Liquid C6

In substantially the same manner as that of release agent particle dispersion liquid C1 except that sodium chloride is replaced with 6.0 parts of calcium chloride dihydrate (made by Wako Pure Chemical Industries, Ltd.), release agent particle dispersion liquid C6 is produced.

Production of Release Agent Particle Dispersion Liquid C7

In substantially the same manner as that of release agent particle dispersion liquid C1 except that sodium chloride is replaced with 10.0 parts of aluminum chloride hexahydrate (made by Wako Pure Chemical Industries, Ltd.), release agent particle dispersion liquid C7 is produced.

Production of Release Agent Particle Dispersion Liquid C8

In substantially the same manner as that of release agent particle dispersion liquid C1 except that metal salt is not added, release agent particle dispersion liquid C8 is produced.

Types of metal salts and additive amounts of metal salts in the release agent particle dispersion liquids are shown in Table 1.

TABLE 1

| release agent particle dispersion liquid | metal salt | additive amount of metal salt (parts) |
|---|---|---|
| C1 | sodium chloride | 5 |
| C2 | sodium chloride | 1.8 |
| C3 | sodium chloride | 7.8 |
| C4 | sodium chloride | 1.3 |
| C5 | sodium chloride | 11.8 |
| C6 | calcium chloride | 6.0 |
| C7 | aluminum chloride | 10 |
| C8 | — | — |

Example 1 ion-exchange water: 450 parts polyester resin dispersion liquid 1: 205 parts polyester resin dispersion liquid 2: 205 parts release agent particle dispersion liquid C1: 100 parts anionic surfactant (NEOGEN RK, trade name, made by Dai-Ichi Kogyo Seiyaku Co., Ltd., 20%): 2.8 parts The above components are introduced into a 3-L flask having a thermometer, a pH meter, and a stirrer, and are left under conditions of a temperature of 30° C. and the number of stirring revolutions of 150 rpm for 30 minutes while externally controlling the temperature using a mantle heater.

The following white pigment dispersion liquids are introduced into the emulsification liquid and this state is maintained for 5 minutes. 1.0% nitric acid aqueous solution is added thereto to adjust the pH in an aggregation process to 3.0.

white pigment dispersion liquid A1: 275 parts (corresponding to 25% of toner particles)

white pigment dispersion liquid B1: 165 parts (corresponding 15% of toner particles)

0.4 parts of polyaluminum chloride is added to the mixture obtained by introducing the white pigment dispersion liquid to the emulsification liquids as described above, while dispersing the mixture with a homogenizer (ULTRA TURRAX T50, trade name, made by IKA Corporation). Thereafter, the temperature is raised up to 50° C. while stirring the resultant, and the particle diameters are measured with COULTER COUNTER TA-II type (trade name, made by Coulter Inc.) with an aperture diameter of 50 μm, whereby the volume-average particle diameter is adjusted to 5.5 μm. Thereafter, 91 parts of polyester resin dispersion liquid 1 and 91 parts of polyester resin dispersion liquid 2 are added thereto, and the resin particles are attached to the surfaces of the aggregated particles.

Thereafter, the pH is adjusted to 9.0 using a 5% sodium hydroxide aqueous solution. Then, the temperature of the resultant is raised up to 90° C. at temperature-raising rate of 0.05° C./min, and is maintained at 90° C. for 3 hours. Thereafter the resultant is cooled, and is filtrated. The resultant is dispersed in ion-exchange water again, is filtrated, and is repeatedly washed until the electric conductivity of the filtrate is 20 μS/cm or less, followed by drying in vacuum in an oven of 40° C. for 5 hours, whereby white toner particles are obtained.

1.5 parts of hydrophobic silica (Ry50, trade name, made by NIPPON AEROSIL CO., LTD.) with respect to 100 parts of the obtained toner particles is added and blended at 10,000 rpm for 30 seconds with a sample mill. Thereafter, the resultant is sieved using a shaking sieve with a mesh size of 45 μm to obtain a white toner. The volume-average particle diameter of the obtained white toner particles is 6.1 μm.

Then, 4 parts of the obtained white toner and 96 parts of carrier A as described below are blended and stirred with a V-shaped blender for 5 minutes, whereby a developer is produced.

Carrier A

Ferrite particles (with a volume-average particle diameter of 35 μm, made by Powder Tech Corp.): 100 parts toluene: 14 parts perfluorooctylethyl acrylate/methylmethacrylate copolymer (copolymerization ratio=40:60, weight-average molecular weight Mw=50,000): 0.8 parts carbon black (VXC-72, trade name, made by Cabot Corporation): 0.06 parts cross-linked melamine resin particles (number-average particle diameter: 0.3 μm): 0.15 parts The components other than the ferrite particles in the above components are dispersed with a stirrer for 10 minutes to obtained a coating film forming liquid. The obtained coating film forming liquid and the ferrite particles are introduced into a vacuum deaeration type kneader and are stirred at 60° C. for 30 minutes, the pressure is lowered to distill off toluene, and a resin coating is formed on the surfaces of the ferrite particles, whereby carriers are produced.

Example 2

In substantially the same manner as that of Example 1 except that white pigment dispersion liquid A1 is replaced with white pigment dispersion liquid A2, a white toner is produced and a developer is produced using the white toner.

Example 3

In substantially the same manner as that of Example 1 except that white pigment dispersion liquid A1 is replaced with white pigment dispersion liquid A3, a white toner is produced and a developer is produced using the white toner.

Example 4

In substantially the same manner as that of Example 1 except that white pigment dispersion liquid B1 is replaced with white pigment dispersion liquid B2, a white toner is produced and a developer is produced using the white toner.

Example 5

In substantially the same manner as that of Example 1 except that white pigment dispersion liquid B1 is replaced with white pigment dispersion liquid B3, a white toner is produced and a developer is produced using the white toner.

Example 6

In substantially the same manner as that of Example 1 except that release agent dispersion liquid C1 is replaced with release agent dispersion liquid C6, a white toner is produced and a developer is produced using the white toner.

Example 7

In substantially the same manner as that of Example 1 except that release agent dispersion liquid C1 is replaced with release agent dispersion liquid C7, a white toner is produced and a developer is produced using the white toner.

Example 8

In substantially the same manner as that of Example 1 except that release agent dispersion liquid C1 is replaced with release agent dispersion liquid C2, a white toner is produced and a developer is produced using the white toner.

Example 9

In substantially the same manner as that of Example 1 except that release agent dispersion liquid C1 is replaced with release agent dispersion liquid C3, a white toner is produced and a developer is produced using the white toner.

Example 10

In substantially the same manner as that of Example 1 except that the additive amount of white pigment dispersion liquid A1 is changed to 110 parts (corresponding to 10% of toner particles) and the additive amount of white pigment dispersion liquid B1 is changed to 110 parts (corresponding to 10% of toner particles), a white toner is produced and a developer is produced using the white toner.

Example 11

In substantially the same manner as that of Example 1 except that the additive amount of white pigment dispersion liquid A1 is changed to 330 parts (corresponding to 30% of toner particles) and the additive amount of white pigment dispersion liquid B1 is changed to 220 parts (corresponding to 20% of toner particles), a white toner is produced and a developer is produced using the white toner.

Example 12

In substantially the same manner as that of Example 1 except that release agent dispersion liquid C1 is replaced with release agent dispersion liquid C4, a white toner is produced and a developer is produced using the white toner.

Example 13

In substantially the same manner as that of Example 1 except that release agent dispersion liquid C1 is replaced with release agent dispersion liquid C5, a white toner is produced and a developer is produced using the white toner.

Comparative Example 1

In substantially the same manner as that of Example 1 except that white pigment dispersion liquid A1 is replaced with white pigment dispersion liquid A4, a white toner is produced and a developer is produced using the white toner.

Comparative Example 2

In substantially the same manner as that of Example 1 except that white pigment dispersion liquid A1 is replaced with white pigment dispersion liquid A5, a white toner is produced and a developer is produced using the white toner.

Comparative Example 3

In substantially the same manner as that of Example 1 except that white pigment dispersion liquid B1 is replaced with white pigment dispersion liquid B4, a white toner is produced and a developer is produced using the white toner.

Comparative Example 4

In substantially the same manner as that of Example 1 except that white pigment dispersion liquid B1 is replaced with white pigment dispersion liquid B5, a white toner is produced and a developer is produced using the white toner.

Comparative Example 5

In substantially the same manner as that of Example 1 except that white pigment dispersion liquid B1 is replaced with white pigment dispersion liquid B6, a white toner is produced and a developer is produced using the white toner.

Comparative Example 6

In substantially the same manner as that of Example 1 except that the additive amount of white pigment dispersion liquid A1 is changed to 110 parts (corresponding to 10% of toner particles) and the additive amount of white pigment dispersion liquid B1 is changed to 55 parts (corresponding to 5% of toner particles), a white toner is produced and a developer is produced using the white toner.

Comparative Example 7

In substantially the same manner as that of Example 1 except that the additive amount of white pigment dispersion liquid A1 is changed to 440 parts (corresponding to 40% of toner particles) and the additive amount of white pigment dispersion liquid B1 is changed to 220 parts (corresponding to 20% of toner particles), a white toner is produced and a developer is produced using the white toner.

Comparative Example 8

In substantially the same manner as that of Example 1 except that release agent dispersion liquid C1 is replaced with white pigment dispersion liquid C8, a white toner is produced and a developer is produced using the white toner.

Evaluation

The developers employing the obtained white toners are set into a reconstructed machine (reconstructed so that white image forming units are added in 4-drum tandem) of DOCUCENTERCOLOR F450 (trade name, made by Fuji Xerox Co., Ltd.), the toner load on the paper is adjusted to 0.7 mg/cm$^2$ under the conditions of 23° C. and 55% RH, and an image is formed on J-PAPER (trade name, made by Fuji Xerox Co., Ltd.) or OHP.

Regarding the image, a white (image density coverage of 100%)-evaluation image (30 mm×40 mm solid image) is printed out, the fixing temperature is set to 160° C., and the concealment property, the bending strength (fixing ability), the image cracking (mechanical strength), and the image storage stability of the image are evaluated. The evaluation results are shown in Tables 2-1 and 2-2. In Tables 2-1 and 2-2, Ex. 1 to Ex. 13 denote Example to Example 13 respectively, and Corn. Ex. 1 to Corn. Ex. 8 denote Comparative Example 1 to Comparative Example 8, respectively.

Concealment Property

A solid image part of an OHP film is superposed on a card with a thickness of 1 mm having a monochromatic pattern printed thereon, the concealment property of the image is visually observed, and the concealment property is evaluated on the basis of the following criteria.

A: The monochromatic pattern on the card is almost completely concealed

B: The monochromatic pattern on the card is very dimly seen through, which is practically non-problematic level.

C: The monochromatic pattern on the card is dimly seen through.

D: The monochromatic pattern on the card is clearly seen through.

Bending Strength (Fixing Ability)

The image surface of the solid image part is bent using a weight with a predetermined load, the bent part is rubbed with gauze, the image loss generated due to the rubbing is visually observed, and the image defect is evaluated on the basis of the following criteria.

G1: An image defect also occurs in a part other than the bent part at the same time as when the part is rubbed with the gauze, and the image is hardly fixed at all.

G2: When rubbed with the gauze, an image defect occurs as a wide white band in the bent part and the periphery thereof.

G3: When rubbed with the gauze, an image defect occurs as a white band in the bent part, and cracking or the like also occurs in the periphery thereof.

G4: When rubbed with the gauze, an image defect occurs as a thin white band in the bent part only, which is practically a non-problematic level.

G5: Even when rubbed with the gauze, an image defect hardly occurs, and just the bending trace is visible.

Image Cracking (Mechanical Strength)

The solid image part is sequentially wound on five types of metal rolls with different radii (radius=40 mm, 30 mm, 20 mm, 10 mm, and 5 mm) from the largest-diameter roll to the smallest-diameter roll, the existence of the cracking is visually observed, the minimum radius with which the cracking breaking is not caused is examined, and the image cracking is evaluated on the basis of the following criteria.

A: The minimum radius of the metal roll with which the cracking is not caused is less than 10 mm.

B: The minimum radius of the metal roll with which the cracking is not caused is equal to or more than 10 mm and less than 30 mm.

C: The minimum radius of the metal roll with which the cracking is not caused is 30 mm or more.

Image Storability

The developers employing the obtained white toners are set into a reconstructed machine (reconstructed so that white image forming units are added in 4-drum tandem) of copier DOCUCENTERCOLOR F450 (trade name, made by Fuji Xerox Co., Ltd.), and two solid images (18 cm×27 cm) of which the toner load on the paper is 0.7 mg/cm$^2$ are formed under the conditions of 23° C. and 55% RH. The recording sheets having the solid image formed thereon are superposed so that the images come in contact with each other, the resultant is left with a vertical load of 100 g/cm$^2$ under the environment of 55° C. for 28 days, and the image defect due to the contact between the images is evaluated.

A: Excellent

B: Good (no major defect)

C: Practically non-problematic but an image defect is observed.

D: Practically intolerable and the image defect is great.

TABLE 2-1

| | first white pigment | | | | second white pigment | | | | | release agent dispersion liquid | | |
|---|---|---|---|---|---|---|---|---|---|---|---|---|
| | dispersion liquid | pigment | specific gravity of pigment | amount of pigment in toner particles (%) | dispersion liquid | pigment | specific gravity of pigment | amount of pigment in toner particles (%) | pigment content in toner particles (%) | dispersion liquid | metal salt | content of metal salt (atom %) |
| Ex. 1 | A1 | titanium dioxide | 4.2 | 25 | B1 | hollow silica | 0.59 | 15 | 40 | C1 | NaCl | 0.62 |
| Ex. 2 | A2 | titanium dioxide | 3.7 | 25 | B1 | hollow silica | 0.59 | 15 | 40 | C1 | NaCl | 0.63 |

TABLE 2-1-continued

| | first white pigment | | | | second white pigment | | | | | release agent dispersion liquid | | |
|---|---|---|---|---|---|---|---|---|---|---|---|---|
| | dispersion liquid | pigment | specific gravity of pigment | amount of pigment in toner particles (%) | dispersion liquid | pigment | specific gravity of pigment | amount of pigment in toner particles (%) | pigment content in toner particles (%) | dispersion liquid | metal salt | content of metal salt (atom %) |
| Ex. 3 | A3 | zinc oxide | 5.6 | 25 | B1 | hollow silica | 0.59 | 15 | 40 | C1 | NaCl | 0.60 |
| Ex. 4 | A1 | titanium dioxide | 4.2 | 25 | B2 | SX866(A) | 0.42 | 15 | 40 | C1 | NaCl | 0.64 |
| Ex. 5 | A1 | titanium dioxide | 4.2 | 25 | B3 | LX407BP | 1.02 | 15 | 40 | C1 | NaCl | 0.61 |
| Ex. 6 | A1 | titanium dioxide | 4.2 | 25 | B1 | hollow silica | 0.59 | 15 | 40 | C6 | $CaCl_2$ | 0.65 |
| Ex. 7 | A1 | titanium dioxide | 4.2 | 25 | B1 | hollow silica | 0.59 | 15 | 40 | C7 | $AlCl_3$ | 0.59 |
| Ex. 8 | A1 | titanium dioxide | 4.2 | 25 | B1 | hollow silica | 0.59 | 15 | 40 | C2 | NaCl | 0.15 |
| Ex. 9 | A1 | titanium dioxide | 4.2 | 25 | B1 | hollow silica | 0.59 | 15 | 40 | C3 | NaCl | 1.45 |
| Ex. 10 | A1 | titanium dioxide | 4.2 | 10 | B1 | hollow silica | 0.59 | 10 | 20 | C1 | NaCl | 0.66 |
| Ex. 11 | A1 | titanium dioxide | 4.2 | 30 | B1 | hollow silica | 0.59 | 20 | 50 | C1 | NaCl | 0.59 |
| Ex. 12 | A1 | titanium dioxide | 4.2 | 25 | B1 | hollow silica | 0.59 | 15 | 40 | C4 | NaCl | 0.05 |
| Ex. 13 | A1 | titanium dioxide | 4.2 | 25 | B1 | hollow silica | 0.59 | 15 | 40 | C5 | NaCl | 1.82 |
| Com. Ex. 1 | A4 | potassium titanate | 3.3 | 25 | B1 | hollow silica | 0.59 | 15 | 40 | C1 | NaCl | 0.55 |
| Com. Ex. 2 | A5 | white lead | 6.55 | 25 | B1 | hollow silica | 0.59 | 15 | 40 | C1 | NaCl | 0.60 |
| Com. Ex. 3 | A1 | titanium dioxide | 4.2 | 25 | B4 | silica | 2.2 | 15 | 40 | C1 | NaCl | 0.59 |
| Com. Ex. 4 | A1 | titanium dioxide | 4.2 | 25 | B5 | SX8782(P) | 0.25 | 15 | 40 | C1 | NaCl | 0.58 |
| Com. Ex. 5 | A1 | titanium dioxide | 4.2 | 25 | B6 | SHIGENOX OWP | 1.4 | 15 | 40 | C1 | NaCl | 0.63 |
| Com. Ex. 6 | A1 | titanium dioxide | 4.2 | 10 | B1 | hollow silica | 0.59 | 5 | 15 | C1 | NaCl | 0.66 |
| Com. Ex. 7 | A1 | titanium dioxide | 4.2 | 40 | B1 | hollow silica | 0.59 | 20 | 60 | C1 | NaCl | 0.61 |
| Com. Ex. 8 | A1 | titanium dioxide | 4.2 | 25 | B1 | hollow silica | 0.59 | 15 | 40 | C8 | — | — |

TABLE 2-2

| | concealment property | bending strength (fixing ability) | image cracking (mechanical strength) | image storability |
|---|---|---|---|---|
| Ex. 1 | A | G5 | A | A |
| Ex. 2 | A | G4 | A | A |
| Ex. 3 | B | G4 | B | A |
| Ex. 4 | A | G4 | A | A |
| Ex. 5 | B | G4 | B | A |
| Ex. 6 | A | G5 | A | B |
| Ex. 7 | A | G5 | A | B |
| Ex. 8 | A | G5 | A | B |
| Ex. 9 | A | G5 | A | B |
| Ex. 10 | B | G5 | A | A |
| Ex. 11 | A | G4 | B | A |
| Ex. 12 | A | G5 | A | C |
| Ex. 13 | A | G5 | A | C |
| Com. Ex. 1 | A | G3 | B | B |
| Com. Ex. 2 | D | G3 | B | B |
| Com. Ex. 3 | B | G3 | B | B |
| Com. Ex. 4 | A | G3 | B | B |
| Com. Ex. 5 | A | G3 | B | B |
| Com. Ex. 6 | D | G5 | A | B |
| Com. Ex. 7 | A | G1 | C | B |
| Com. Ex. 8 | A | G5 | A | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. A white toner for electrostatic charge image development comprising a binder resin, a first white pigment, a second white pigment, and a release agent, a specific gravity D1 of the first white pigment satisfying a condition of $3.5<D1<6.0$, a specific gravity D2 of the second white pigment satisfying a condition of $0.3<D2<1.2$, a total content of the first white pigment and the second white pigment being in the range of from about 20% by weight to about 50% by weight with respect to a total weight of the white toner for electrostatic charge image development, and the release agent including a metal salt, wherein the second white pigment is a pigment having a hollow structure.

2. The white toner for electrostatic charge image development according to claim 1, wherein the metal salt includes an element of Group I of the Periodic Table or an element of Group II of the Periodic Table.

3. The white toner for electrostatic charge image development according to claim 1, wherein a content of the metal salt included in the release agent is from about 0.1 atom % to about 1.5 atom % with respect to the release agent.

4. The white toner for electrostatic charge image development according to claim 1, wherein a content of the first white pigment is greater than a content of the second white pigment.

5. The white toner for electrostatic charge image development according to claim 1, wherein the binder resin includes an amorphous resin.

6. The white toner for electrostatic charge image development according to claim 5, wherein a content of the amorphous resin with respect to components constituting the white toner particles is from about 50% by weight to about 80% by weight.

7. The white toner for electrostatic charge image development according to claim 5, wherein a weight-average molecular weight (Mw) of the amorphous resin is from about 5,000 to about 1,000,000.

8. The white toner for electrostatic charge image development according to claim 5, wherein the glass-transition temperature of the amorphous resin is from about 35° C. to about 100° C.

9. The white toner for electrostatic charge image development according to claim 1, wherein a content of the release agent with respect to components constituting the white toner particles is from about 1% by weight to about 10% by weight.

10. The white toner for electrostatic charge image development according to claim 1, wherein the main peak of the release agent, measured in accordance with ASTMD3418-8, is from about 50° C. to about 140° C.

11. The white toner for electrostatic charge image development according to claim 1, wherein a viscosity $\eta 1$ of the release agent at 160° C. is from about 20 cps to about 600 cps.

12. The white toner for electrostatic charge image development according to claim 1, wherein a volume-average particle diameter of the white toner particles is from about 4 μm to about 9 μm.

13. The white toner for electrostatic charge image development according to claim 1, wherein a shape factor SF1 of the white toner for electrostatic charge image development is from about 115 to about 140.

14. An electrostatic charge image developer comprising the white toner for electrostatic charge image development according to claim 1.

* * * * *